United States Patent [19]

Williams et al.

[11] Patent Number: 4,592,786

[45] Date of Patent: Jun. 3, 1986

[54] PROCESS FOR CLEANING AN OIL CONTAMINATED VESSEL

[75] Inventors: Joseph L. Williams; John W. Sansing, both of Greenville, Miss.; Michael E. Hayes, Fernandina Beach; James F. Deal, Amelia Island, both of Fla.

[73] Assignee: Petroleum Fermentations N.V., Curacao, Netherlands Antilles

[21] Appl. No.: 649,247

[22] Filed: Oct. 26, 1984

Related U.S. Application Data

[63] Continuation of Ser. No. 512,489, Jul. 11, 1983, abandoned.

[51] Int. Cl.[4] ..... B08B 3/02; B08B 5/02

[52] U.S. Cl. ..... 134/22.18; 134/22.19; 134/40; 134/168 R

[58] Field of Search ..... 134/10, 22.18, 22.19, 134/40, 167 R, 168 R, 169 R

[56] References Cited

U.S. PATENT DOCUMENTS

| | | | |
|---|---|---|---|
| 1,693,885 | 12/1928 | Butterworth | 134/168 R |
| 3,013,665 | 12/1961 | Schmidt et al. | 134/168 R X |
| 3,022,792 | 2/1962 | Perkins | 134/168 R |
| 3,436,263 | 4/1969 | Strenkert et al. | 134/22.19 |
| 4,364,776 | 12/1982 | McBride et al. | 134/40 X |
| 4,426,233 | 1/1984 | Manabe et al. | 134/22.18 X |

FOREIGN PATENT DOCUMENTS

| | | | |
|---|---|---|---|
| 951618 | 3/1964 | United Kingdom | 134/22.19 |

*Primary Examiner*—George Yeung
*Attorney, Agent, or Firm*—Pennie & Edmonds

[57] ABSTRACT

An apparatus and process adapted to clean oil contaminated vessels which uses a closed fluidized system through which fluidized sludge is recirculated to be sprayed under pressure on interior walls of the vessel. Emulsifying agents are added to the vessel to initially form a pool of fluidized sludge in the vessel which is then conveyed to a tank and from the tank conveyed to a high pressure spray where it is sprayed onto the walls to fluidize more sludge.

13 Claims, 2 Drawing Figures

PROCESS FOR CLEANING AN OIL CONTAMINATED VESSEL

This is a continuation of application Ser. No. 512,489 filed July 11, 1983, now abandoned.

FIELD OF THE INVENTION

This invention relates to an apparatus and process for cleaning an oil contaminated vessel having one or more cargo compartments each containing sludge utilizing a closed fluidized circuit.

BACKGROUND OF THE INVENTION

Vessels containing oil, such as storage tanks, tank cars, oceangoing tankers, barges, pipelines or other structures for storing or transporting crude oil or petroleum products will over a period of time accumulate large amounts of sludge made up of chemical or hydrocarbon deposits which deposits occur particularly in crude oils or heavy oils. Build up of such sludge over a period of time subtracts from the load carrying or storage capacity of the vessel. Further build up of sludge in oil conveying vessels such as tank cars or trucks results in carrying excess dead weight when the vessel is returned empty from a delivery point to a shipping point thus increasing cost of operations. Consequently the interiors of such vessels must be cleaned from time to time of accumulation of sludge.

Further vessels carrying or storing crude oil or other petroleum products, particularly barges and oceangoing tankers, are often used to carry other products besides oils or carry other grades of oils. It thus becomes necessary to cleanse the interior of such vessels prior to being loaded with other products or higher grades of oil Vessels of this type must be cleansed to a gas free state from time to time so that they may be entered for periodic inspection or for repair in the event of damage.

Existing techniques for cleaning oil carrying vessels has involved the use of steam and water applied in large volumes through spray nozzles against interior side walls of the vessels under high pressure. Occasionally chemicals are used in the cleaning but generally such cleaning systems involve the use of large volumes of water. This technique of cleaning has proved to be labor intensive, energy intensive, and generally results in the formation of large volumes of oil contaminated waste water. Vessels cleaned utilizing this technique are often not completely free of hydrocarbon deposits and are not suitable for upgrading and carrying or storing other products without further hand cleaning of the interior of the vessel.

It is therefore an object of our invention to provide for an apparatus and process for cleaning an oil contaminated vessel which will utilize a minimum of water and which will substantially completely clean an oil contaminated vessel of oil and any sludge in a comparatively short time and at minimal expense.

It is a still further object of the invention to provide for an apparatus and method of cleaning oil contaminated vessels of oil and sludge by which usable oil may be conveniently recovered for further use.

GENERAL DESCRIPTION OF THE INVENTION

Broadly a process for cleaning an oil contaminated vessel according to our invention involves use of a closed recirculating fluidized system or circuit where the system has a tank, a discharge means extending from the interior of a compartment within the vessel to the tank and a pressurized spray means extending from the tank to the interior of the compartment by which the contents of the tank may be sprayed onto the interior walls of the compartment. The process involves the steps of treating the sludge with a fluidizing agent to form a pool of fluidized sludge which is then circulated through the system and sprayed under pressure onto the interior walls of the compartment. When the fluidized sludge spray contacts the walls it cleans oil from the walls and also fluidizes any sludge thereon to increase the size of the pool in the bottom of the compartment containing fluidized sludge. This fluidized sludge is then discharged from the vessel to the tank where it is recirculated again through the pressurized spray means back to the compartment. This recirculation is continued until the compartment is substantially cleansed of sludge leaving only a film of self emulsifiable oil.

The fluidizing agent may be initially added directly to the compartment to form an initial pool of fluidized sludge which is then conveyed to the tank or the agent may be added directly to the tank after which it is circulated through the pressurized spray means onto the interior side walls of the compartment so as to form a pool of fluidized sludge.

Preferably the fluidized sludge is heated conveniently by a heat exchanger in the tank to further enhance the cleaning action. The tank itself may act as a settling tank to capture any large solids such as rust or sand particles to prevent their being recirculated in the closed system through the pressurized spray means.

Sufficient fluidizing agent is periodically added to the system, either directly to the tank or to the compartment being cleaned, to maintain fluidity of the sludge.

The process may include the further step of periodically removing excess oil from the closed system and transferring it to an oil holding tank.

The remaining film of self emulsifiable oil left in the compartment after being sprayed with the fluidized sludge may then be completely removed by rinsing with a small amount of hot or cold water using a standard spray type Butterworth wash system. The rinse water is then stripped from the compartment and transferred to a separating tank where oil is allowed to separate from the water. The recovered oil may then be used as a fuel or reclaimed for refining and the rinse water may be drawn off and used in subsequent rinsing. By this procedure use of rinse water is minimized while at the same time oil is recovered.

The process described above may use water as a component of a wash solution when the vessel being cleaned contains low grade oil or crude oil sludge. In this case the sludge itself may contain from 0 to 40% water as a water in oil emulsion. The fluidizing agent serves to invert the emulsion to form an oil in water emulsion having much better flow characteristics. #6 oil normally does not contain any water such that the fluidized oil recovered will be water free when vessels containing such oil are cleaned.

The process described above is also applicable for use in cleaning vessels having a plurality of compartments each containing sludge. In this instance fluidized sludge from the first compartment cleansed is sprayed into a second or further compartment to form an initial pool of fluidized sludge in the second compartment which is then recirculated through the closed fluidized system until the second compartment is substantially cleansed of sludge.

An apparatus constructed according to our invention comprises broadly a tank adapted to hold the fluidized sludge or emulsion, a pressurized spray means extending from the tank and adapted to extend into the interior of a compartment containing sludge and a discharge means having one end connected to the tank and an opposite end adapted to be connected to the compartment to remove fluidized sludge or emulsion therefrom to the tank.

The pressurized spray means preferably includes a first pump and the discharge means a second pump with both pumps being of equal capacity and driven by a common drive means to assure that both operate with equal throughput.

The pumps, drive means and tank are mounted on a common base such as a skid to form a unit which can be conveniently lifted into position, as for example onto the deck of a barge, in order to clean cargo compartments.

The tank preferably has a vertical baffle therein dividing the tank into a solids settling portion and into a substantially solids free portion connected to the pressurized spray means.

The apparatus also preferably may include a separating tank in which excess oil or emulsion may be transferred from the closed fluidized circuit. Oil is allowed to separate from the emulsion in the separating tank where it is then removed for further use while the remaining water is available for further use.

DETAILED DESCRIPTION OF THE PREFERRED EMBODIMENTS

Figure 1:
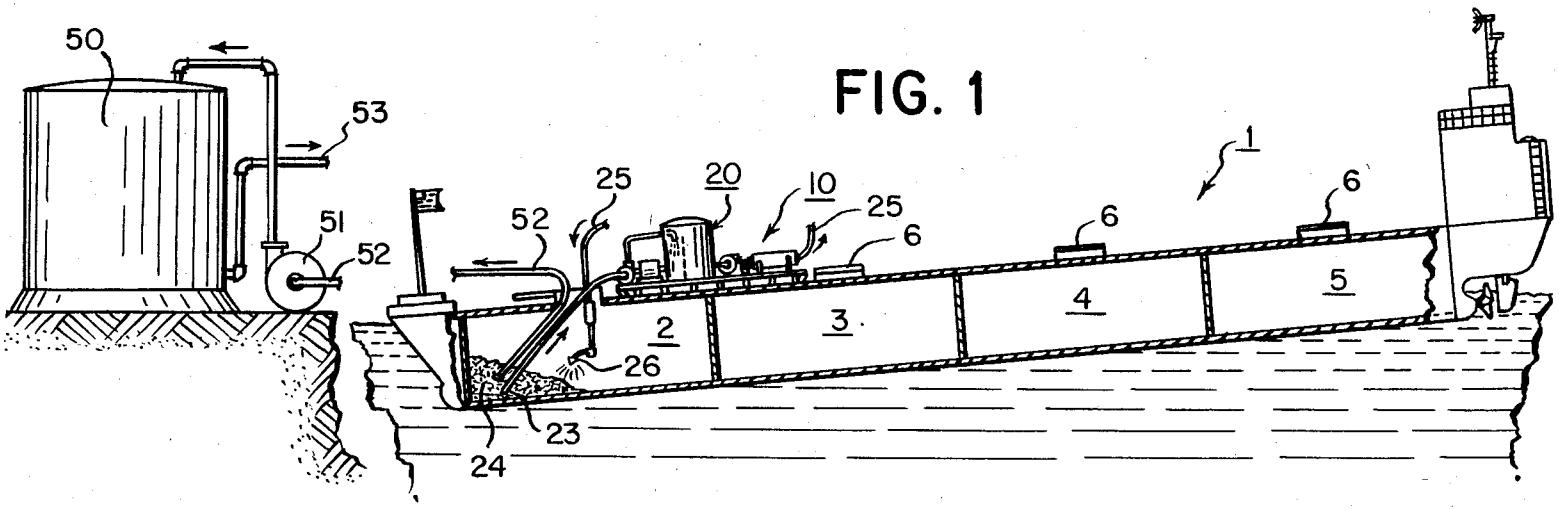
FIG. 1 is a diagrammatic view of an apparatus constructed according to the invention mounted in part on an oil tanker having a plurality of compartments to be cleaned; and, FIG. 2 is an enlarged sectional view of a portion of the apparatus disclosed in FIG. 1.

Referring to FIG. 1, there is illustrated a vessel in the form of an oil tanker 1 having a plurality of cargo compartments 2, 3, 4 and 5 accessible by hatches 6.

Figure 2:
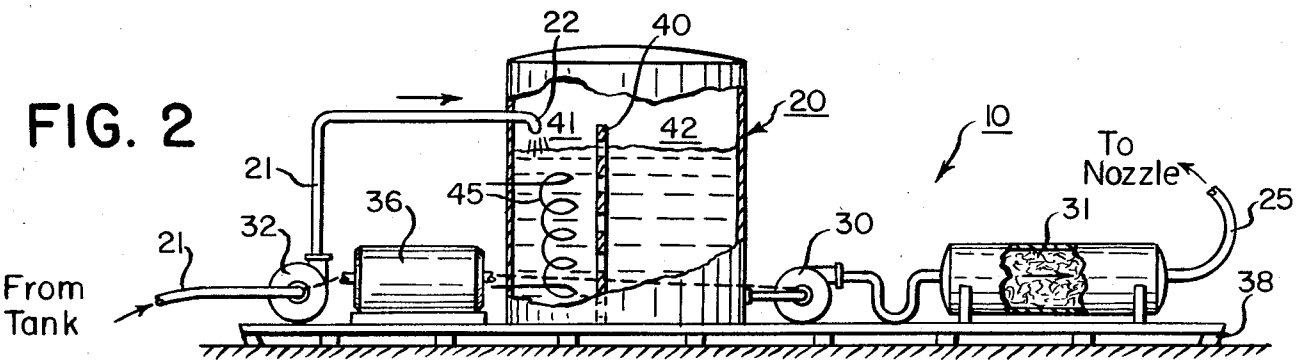

An apparatus 10 adapted to clean the compartments is lifted into place onto the deck of the tanker where it is available for operation. As shown in FIG. 2, the apparatus comprises a tank 20, a discharge means 21 having one end 22 connected to the tank 20 and an opposite end 23, shown in FIG. 1, adapted to extend into a pool 24 of fluidized sludge in a compartment in order to discharge fluidized sludge or an emulsion from the compartment into the tank 20.

The apparatus 10 also includes a pressurized spray means 25 terminating in a spray head or nozzle 26 adapted to extend into a compartment in order that fluidized sludge or emulsion contained in the tank 20 may be sprayed under pressure onto the interior side walls and bottom of a compartment to clean the same of sludge.

The pressurized spray means 25 includes a first pump 30 to convey emulsion under pressure to the nozzle 26. If desired, filter means 31 may be included in the pressurized spray means to catch and filter any debris that might clog the nozzle 26.

The discharge means 21 includes a second pump 32 the intake of which is adapted to communicate with a compartment and the outlet of which extends to the tank 20.

Pumps 30 and 32 are of equal capacity and are preferably driven by a common drive means 36 in the form of an internal combustion engine or electric motor. The pumps are coupled through independent transmissions so that they may be operated independently or at the same speed and throughput.

The tank 20, pumps 30 and 32 as well as the common drive means 36 are mounted on a base or skid 38 so that the several parts making up the apparatus may be considered as a unit which may be easily lifted onto the deck or other portion of a vessel to be cleaned.

The tank 20 besides acting as a holding tank also acts as a settling tank to entrap large solids, such as sand or rust particles, that may be circulated within the tank. To assist in this function a vertically extending baffle 40 extends upwardly from the bottom of the tank about three quarters of the height of the tank to divide the tank into a solids settling portion 41 and a solids free portion 42. The end 22 of the discharge means 21 discharges into the top of the solids settling portion 41 while the intake of the pump 30 draws from the bottom of the solids free portion 42 which further minimizes likelihood of solids being drawn into the pump 30.

Preferably a heat transfer means in the form of coils 45 are contained in the tank 20 to heat the circulated emulsion to further enhance cleaning action. The coils may be connected by piping to a boiler, not shown, contained at a convenient location, as for example an on-shore site, which heats a heat transfer fluid, for example steam, which is circulated through the coils. While the coils are shown in the solids settling portion of the tank, they could be located in any portion of the closed fluidized system defined by the discharge means 21, the tank 20 and the pressurized spray means 25.

The apparatus preferably also has a holding tank 50 sited on shore to which excess oil or emulsion is drawn by a pump 51 through a discharge conduit 52 which as shown extends into the pool of fluidized sludge 24. The conduit 52 could just as conveniently extend to the tank 20 or other portion of the closed fluidized system to withdraw excess oil or emulsion therefrom. Oil is separted out of the emulsion in the holding tank 50 where it may be removed for further use, as for example, a fuel. The remaining water is then available to be returned by conduit 53 to a holding tank not shown, where it is available for subsequent rinsing of a compartment cleaned of sludge.

The spray head or nozzle 26 preferably comprises a jet nozzle and may be of the portable type such as a Gunclean 270 A manufactured by Salen and Wicander Marin AB, Gothenburg, Sweden. The nozzle is further preferably programmable and driven by air so as to move through predetermined arcs both in vertical planes and in horizontal planes to assure that a jet of fluidized sludge or emulsion will contact those areas of a compartment to be cleaned. We have found that in many vessels, it is not necessary to clean the top of the interior of the vessel since this area does not come into contact with a cargo or a stored material so in such instances the nozzle is programmed such that the jet of emulsion will not contact top interior surfaces of the vessel.

We have found that an apparatus as described operates successfully where the tank 20 has a capacity of approximately 250 gallons and pump pressure is on the order of 100–150 psig. The pumps themselves may be of a progressive cavity type as manufactured by Moyno Products, Robbins & Myers, Inc., Springfield, Ohio The process for cleaning a vessel of contaminated sludge utilizing the apparatus as described above is as follows:

Approximately one fifty-five gallon drum of an emulsifying agent is added to an end compartment of a vessel having a plurality of compartments each having a capacity of approximately two thousand barrels, for example, compartment 2 of the tanker shown in FIG. 1. A hose is attached to the suction side of the pump 32 and lowered to a pickup point at the lowest part of the compartment, which may be conveniently formed by ballasting to impart a list to the tanker to lower one end.

The emulsifying agent will fluidize some of the sludge in the tank so as to form a pool of fluidized sludge. As the sludge becomes fluidized, it is conveyed to the tank 20 by the pump 32 where it can be heated and the fluidized sludge or emulsion (in the case of crude oil) is then circulated through the tank 20 into the pressurized spray means and onto the walls of the compartment. This recirculation of fluidized sludge or emulsion is continued until the compartment walls have been cleansed of sludge and all of the sludge in the bottom of the compartment has been fluidized. During this time it may become necessary to add further fluidizing agent to the recirculated fluidized sludge or emulsion to maintain fluidity of the sludge which can be determined by checking the fluidity in the tank 20.

When all of the sludge in the tank has been fluidized, it is pumped into the holding tank 50 and the nozzle 26 is moved to the next adjacent compartment 3. A small amount of the fluidized sludge or emulsion from compartment 2 may be used as a beginning pool of fluidized sludge for the next adjacent compartment 3 to be cleaned. This is accomplished by leaving the end 23 of the discharge means in the pool 24 of compartment 2 until the nozzle 26 has sprayed sufficient fluidized sludge or emulsion onto the walls of compartment 3 to form a pool of fluidized sludge in that compartment after which the end 23 is moved to the pool in compartment 3 such that fluidized sludge or emulsion from that compartment is then recirculated through the closed fluidizing system. This procedure is repeated for cleaning the remaining compartments.

Portions of the walls of a compartment may be masked or shaded by interior structure from impingement by the spray from the nozzle 26. These untouched portions may be cleaned by a hand-held spray from the deck or by someone entering the compartment to spray the fluidizing agent directly onto the untouched areas followed by washing with a hand-held water hose.

The compartment after cleaning is then rinsed with cold water using Butterworth nozzles for approximately fifteen to thirty minutes to form an oil water emulsion. This emulsion is continuously removed from the compartment during rinsing and transferred to a separating tank, not shown. An oil layer will form on the surface within the holding tank after a few hours and the rinse water may be decanted from the bottom of the tank and recycled for future rinsing.

Emulsifying agents suitable for use in the described process are of the types disclosed in U.S. Pat. No. 4,276,094 and those sold by Petroferm U.S.A., Amelia Island, Fla. No.'s PFC-2209, PFC-0247 or PFC-775.

We have found that the process and apparatus as described above results in much faster cleaning of oil contaminated vessels than when compared to conventional hot water or steam systems. Further because we utilize a closed fluidized system through which fluidized sludge is recirculated, production of large amounts of waste water and attendant disposal problems are minimized.

We claim:

1. A process for cleaning an oil contaminated vessel having at least one compartment containing sludge comprising the steps of initially adding a fluidizing agent containing an emulsifying agent to the one compartment to form an initial pool of fluidized sludge, pumping the fluidized sludge from the said one compartment to a tank, removing the fluidized sludge from the tank and spraying it under pressure onto the interior sides of said one compartment to further fluidize sludge therein, and thereafter continuously recirculating only fluidized sludge from said one compartment back to the tank in a closed fluidized circulation system containing only fluidized sludge therein and until said one compartment is substantially cleansed of sludge.

2. A process for cleaning an oil contaminated vessel having at least one compartment containing sludge comprising the steps of adding an amount of an emulsifying agent to the compartment in sufficient quantities to form an initial pool of fluidized sludge in the compartment, pumping fluidized sludge from said initial pool through a circulation system containing only fluidized sludge and to spray nozzles, spraying the fluidized sludge under pressure from the spray nozzles onto the interior sides of said compartment to form an enlarged pool of fluidized sludge, thereafter continuously circulating only the fluidized sludge from said enlarged pool through said circulation system until said interior sides are substantially cleansed of sludge leaving behind a film of self emulsifiable oil on the sides of the compartment, and thereafter rinsing said sides with water.

3. A process according to claim 2 wherein the fluidized sludge is passed through a heat exchanger to heat said fluidized sludge.

4. A process according to claims 2 or 3 wherein the sludge is substantially water-free and only rinse water is added to the compartment after the interior sides have been substantially cleansed of sludge.

5. A process according to claim 4 wherein sufficient emulsifying agent is added periodically to the continuously circulating fluidized sludge in an amount to maintain fluidity of the sludge being circulated in the system.

6. A process according to claims 2 or 3 wherein the sludge is a crude oil sludge containing water as a water-in-oil emulsion and said fluidizing agent is added to invert the water-in-oil emulsion of the crude oil sludge to an oil-in-water emulsion.

7. A process according to claim 6 wherein sufficient fluidizing agent containing water and an emulsifying agent is added periodically to the continuously circulating further fluidized sludge only in an amount to maintain fluidity of sludge being circulated through the system.

8. A process according to claim 4 including the further step of periodically diverting excess oil from the closed system to a holding tank.

9. A process according to claim 6 including the further step of periodically diverting excess fluidizing agent from the closed system to a holding tank where oil is allowed to be separated from water.

10. A process according to claim 9 including the further step of removing water from said holding tank and using it to rinse said sides.

11. Process according to claim 2 further including rinsing the side walls with water.

12. A process according to claims 1 or 2 wherein the oil is a crude oil containing water with the fluidized sludge being in the form of an oil-in-water emulsion including the further step of periodically diverting excess emulsion from the closed system to a separating tank where oil is removed from said emulsion.

13. A process according to claim 12 including the further step of periodically drawing off water from said separating tank for further use in rinsing a compartment.

* * * * *